United States Patent [19]

Goldfarb et al.

[11] 4,046,380

[45] Sept. 6, 1977

[54] GAME APPARATUS WITH POSITIONAL STRIKERS

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb; Erwin Benkoe, both of Northridge, Calif.

[21] Appl. No.: 638,550

[22] Filed: Dec. 8, 1975

[51] Int. Cl.[2] ..... A63F 7/00

[52] U.S. Cl. ..... 273/119 R; 273/85 B

[58] Field of Search ..... 273/85 R, 85 A-85 F, 273/87 R, 87.2, 87.4, 118-127 R, 129 GA, 129 GB, 129 HA, 129 HB

[56] References Cited

U.S. PATENT DOCUMENTS

| | | | |
|---|---|---|---|
| 2,237,486 | 4/1941 | Henderson | 273/119 R X |
| 2,507,258 | 5/1950 | Kohler | 273/129 HB X |
| 3,235,259 | 2/1966 | Glass et al. | 273/85 F |
| 3,695,612 | 10/1972 | Barrios | 273/87.2 |

FOREIGN PATENT DOCUMENTS

| | | | |
|---|---|---|---|
| 497,144 | 11/1950 | Belgium | 273/85 D |
| 1,071,526 | 3/1954 | France | 273/119 R |
| 1,395,452 | 3/1965 | France | 273/85 B |
| 1,191,455 | 4/1959 | France | 273/119 R |
| 456,193 | 3/1950 | Italy | 273/129 HB |

*Primary Examiner*—Richard J. Apley

*Attorney, Agent, or Firm*—Robert M. Ashen; Robert J. Schaap

[57] ABSTRACT

A competitive action game apparatus including a game board having a playing surface thereon. The playing surface has a high section intermediate each of a pair of opposed player ends and extends downwardly toward each of such player ends. A goal area is located at each of the opposed player ends. A rebound frame surrounds the playing surface except at the goal areas to retain a playing piece in the form of a ball on the surface. The playing surface is generally solid and continuous and uninterrupted between each of the goal areas. Manually shiftable support members are located in front of each of the goal areas and are capable of being shifted transversely in a direction substantially perpendicular to a line extending between the opposed playing ends. A pair of actuable striker elements, which may adopt the form of flippers, are disposed on each of the support members, and are manually actuated by means on the support members. Each player can shift his support member from side to side and can also actuate his flippers to strike the playing piece so as to protect his own goal while attempting to propel the ball into his opponent's goal. The double incline of the playing surface insures that the ball will not stall at an intermediate portion of the playing surface, but will always move down one or the other of the inclines toward a player area where it can be engaged by a striker element. This arrangement permits the use of striker elements which have limited movement such that portions of the playing surface are not within the reach of any of the striker elements.

17 Claims, 8 Drawing Figures

GAME APPARATUS WITH POSITIONAL STRIKERS

BACKGROUND OF THE INVENTION

This invention relates in general to certain new and useful improvements in games, and, more particularly, to a competitive action board game in which there are goals at opposed player ends of the board and each player operates striker means at his end to engage a playing piece to defend his goal and propel the piece toward the opponent's goal.

There are a large number of such competitive action board game devices commercially available. One of the major problems of many of these prior devices is that they fail to provide fast and uninterrupted play action. Where the striker means have restricted movement such as being attached to the board, the playing piece may become stalled in a location not readily accessible to the striker means. This tends to frustrate and annoy the players and detracts from the excitement and continuity of the game play. To alleviate this condition, the striker means may be totally separate from the game board and hand held so that all parts of the board are accessible to the striker means. Such separate striker means pose other problems in that the striker means are more readily lost or misplaced; further, the use of the separate striker means is much less controlled and can become wild and beyond the intended limits of the game play.

It is, therefore, a primary object of the present invention to provide a competitive action game apparatus where a playing piece can be propelled back and forth between a pair of opposed ends of a game board by striker means which have only limited movement, the board being arranged to ensure that the play will not be stopped by the playing piece coming to rest out of the reach of the striker means.

It is a further object to provide such a game apparatus where the board is inclined downwardly toward its opposed ends.

It is a further object to provide such a game apparatus wherein the striker means are movably mounted on shiftable support members.

It is a further object to provide such a game apparatus wherein the striker means on each support member comprise a pair of spaced apart rotatable flippers, and the support member is transversely shiftable.

It is another object of the present invention to provide a game apparatus of the type stated in which the shiftable members and the striker means located thereon are arranged so that the playing piece can pass through various playing piece passages, and into a goal area, unless the support member is shifted and the striker means are located in the trajectory of the playing piece.

It is another salient object of the present invention to provide a method of playing a game where a playing piece can be shifted across a game board toward either of a pair of opposed goal areas and where the game board has a surface which is inclined towards each of the goal areas, striker means at each goal area being limited in mobility and operable by a player to generally contemporaneously (i) move transversely and (ii) move to strike the playing piece.

It is an additional object of the present invention to provide a game apparatus of the type stated which is relatively rigid and durable in its construction, and which can be manufactured at a relatively low unit cost.

It is a further object of the present invention to provide a game apparatus of the type stated which is relatively simple in its construction, but which is nevertheless highly unique and designed to maintain the interest of the players.

With the above and other objects in view, our invention resides in the novel features of form, construction, arrangement and combination of parts presently described and pointed out in the claims.

BRIEF SUMMARY OF THE DISCLOSURE

The disclosed apparatus relates in general to a game apparatus where a pair of opposed players attempt to propel a playing piece in the form of a spherical object or ball toward a goal area at each of the opposite ends of a game board. The illustrated apparatus comprises a game board having an upper playing surface with the pair of goal areas at each of the opposed ends. The playing surface is provided with a high section intermediate each of the goal areas and with inclined sections extending downwardly from the high section toward the goal areas. The playing surface may be curved from each of the opposed ends with the high section at the apex of the curve. Alternatively, the playing surface may include a pair of relatively flat, downwardly inclining sections which incline toward the goal areas and are connected at their upper ends by a curved section which defines a high point on the playing surface. In each case, the playing surface is generally solid and continuous and uninterrupted between each of the goal areas. The ball will always roll to a goal area.

The game board also includes rebound surfaces which surround the playing surface except at the goal areas to retain and repel the ball on the playing surface. A shiftable support member is located in front of each of the goal areas. In the illustrated preferred form, the support members are shiftable transversely in a direction generally perpendicular to a line extending from goal to goal. Moreover, actuable striker elements, which may adopt the form of rotatable flippers, are disposed on each of the support members and are rotatable to engage the ball when actuated. Finally, a manually operable means is associated with each support member to actuate its flippers to cause them to rotate and thereby engage the ball.

The illustrated game apparatus of the present invention can be further characterized in that the support members each carry a pair of manually actuable, spaced apart striker elements. Each of the striker elements can be shifted from an unactuated position to an actuated position where they are projected toward the opposed player end.

In the illustrated game apparatus, the striker elements, which may be flippr flipper define a first passageway therebetween leading to the goal. Moreover, a second passageway to the goal is defined between one of the flipper elements and the portion of the rebound surface in proximity thereto, when the support member is shifted in a first transverse direction. A third passageway to the goal is defined between the other of the flipper elements and the opposed rebound surface when the support member is shifted in a second transverse direction. Each of these passageways are sized to permit passage of the playing piece through and into the goal area associated therewith.

The present invention also provides a method of playing this game with the playing piece shifted across the game board toward one or another of the opposed goal areas. In this case, the method includes the introduction of the playing piece on the game board and permitting this playing piece to move toward one or another of the goal areas. The method further includes a shifting of the support members in a direction transverse to the longitudinal dimension of the game board and actuating a striker element on the shiftable support member to engage the playing piece and propel the same to the opposite goal area.

BRIEF DESCRIPTION OF THE DRAWINGS

Figure 1:
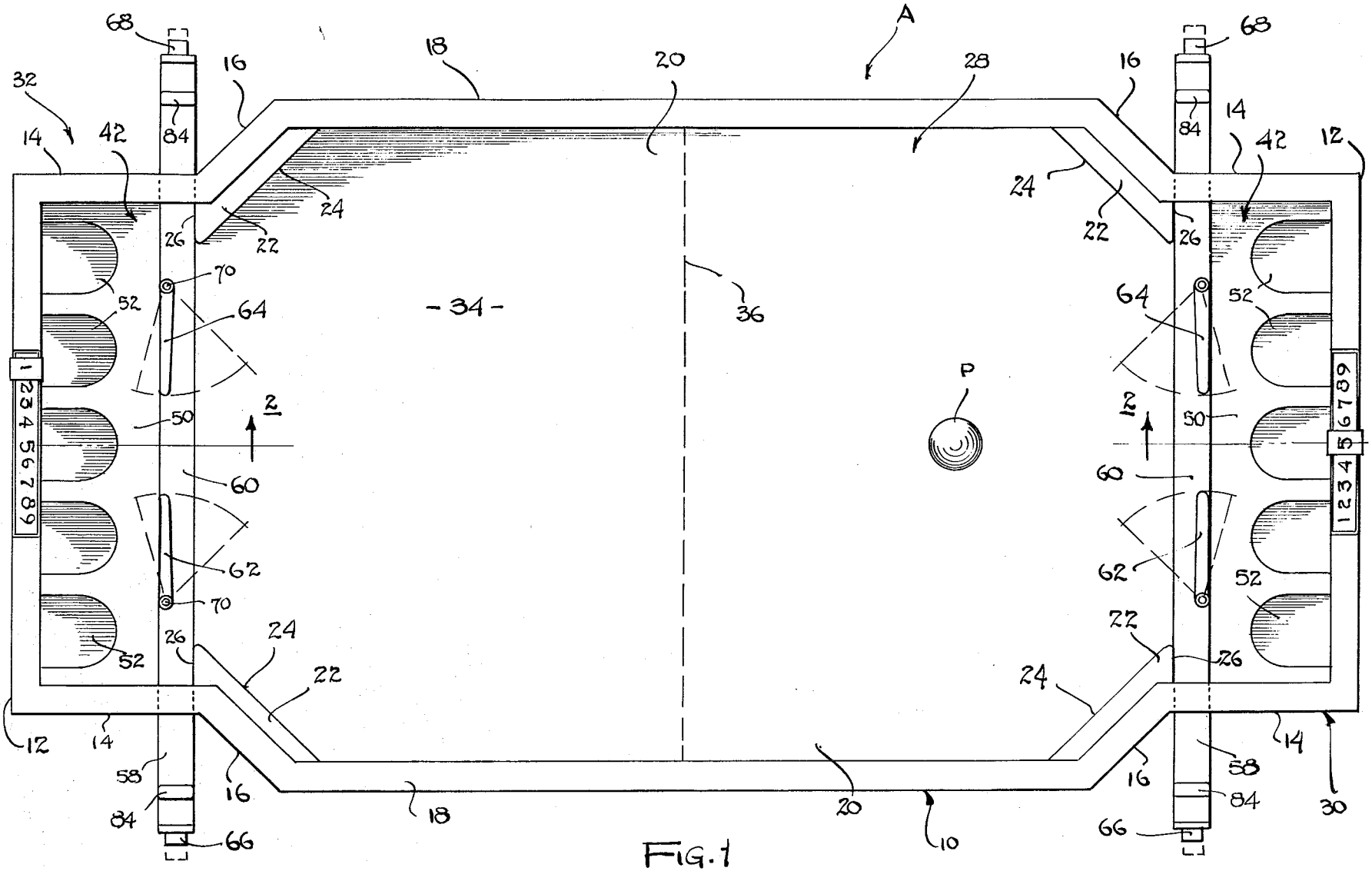
Figure 2:
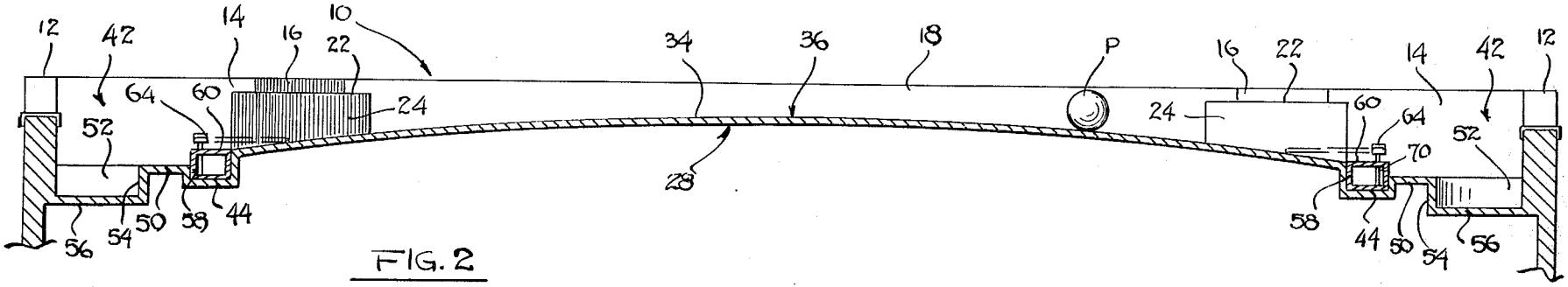
Figure 3:
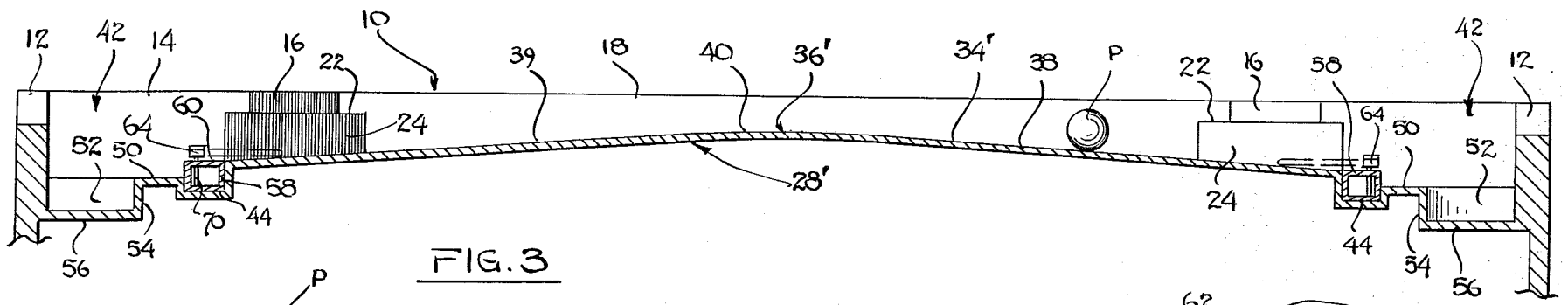
Figure 5:
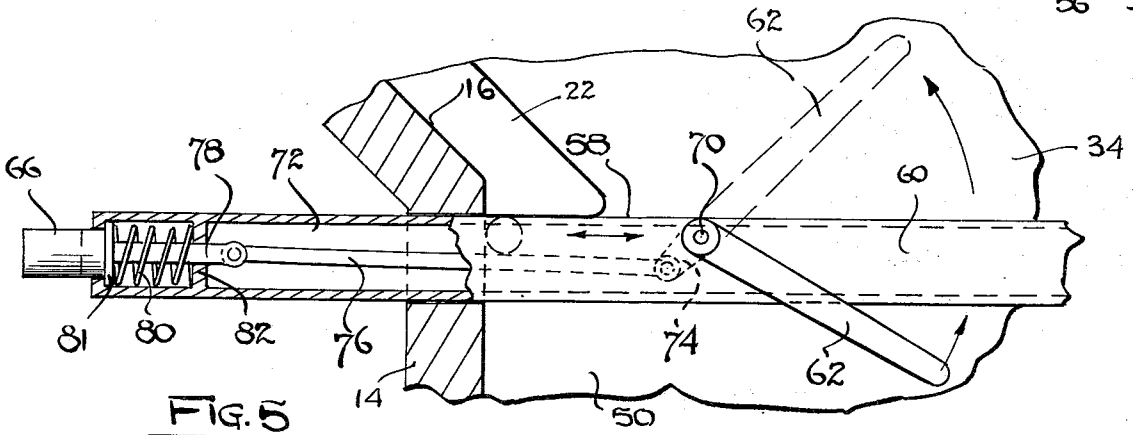
Figure 4:
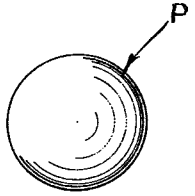
Figure 6:
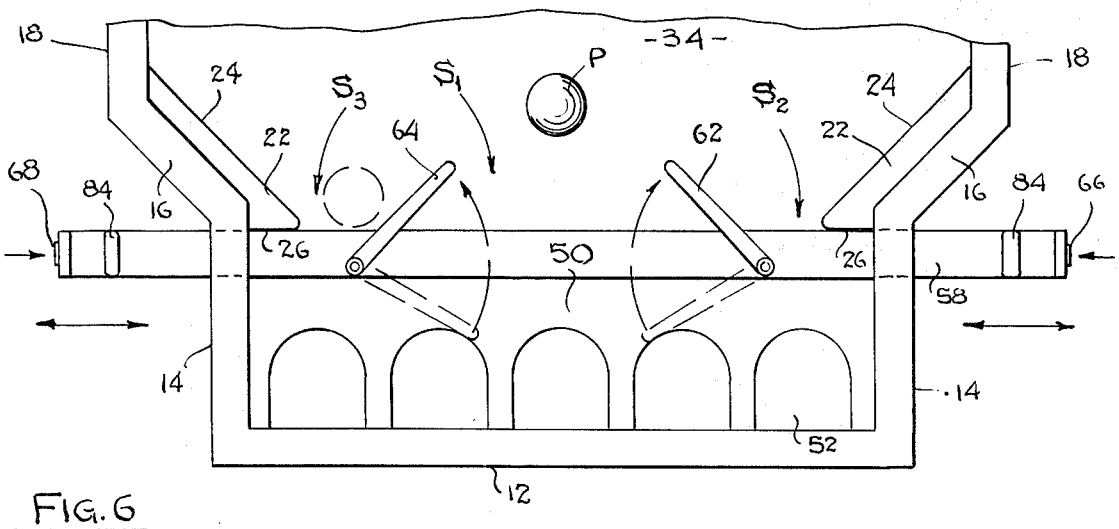
Figure 7:
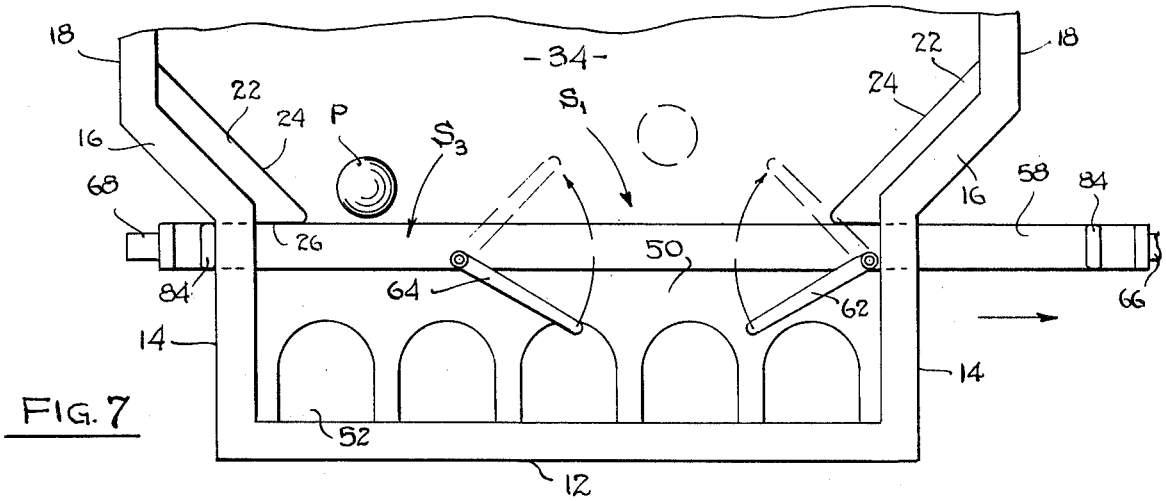
Figure 8:
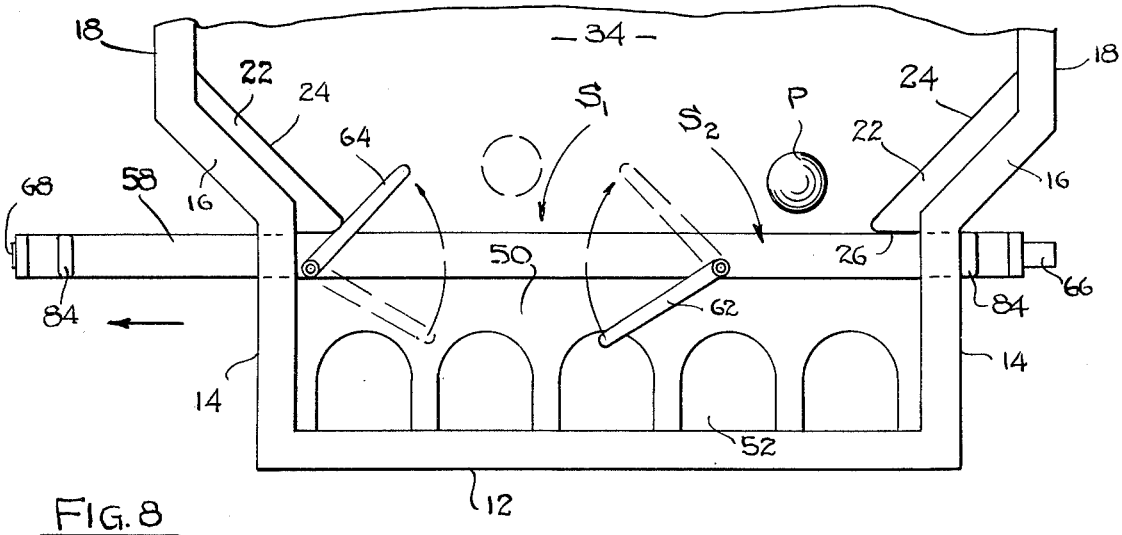

Having thus described the invention in general terms, reference will now be made to the accompanying drawings in which:

FIG. 1 is a top-plan view of a game apparatus constructed in accordance with and embodying the present invention;

FIG. 2 is a vertical sectional view taken along line 2–2 of FIG. 1;

FIG. 3 is a vertical sectional view, similar to FIG. 2, and showing a modified form of game board construction in accordance with the present invention;

FIG. 4 is a top-plan view of a playing piece in the form of a ball, which may be used in the game apparatus of the present invention;

FIG. 5 is a horizontal sectional view showing a portion of the manually operable actuating means to actuate the flippers used in the game apparatus of FIG. 1;

FIG. 6 is a fragmentary top-plan view, partially shown in phantom lines, and showing the position of the flipper support member in a normal position;

FIG. 7 is a fragmentary top-plan view, similar to FIG. 6, and showing the relative position of the flipper support member and the flippers thereon when the support member is shifted in one transverse direction; and FIG. 8 is a fragmentary top-plan view, similar to FIG. 7, and showing the position of the support member and the flippers thereon when the support member is shifted in the opposite transverse direction.

DETAILED DESCRIPTION

Referring now in more detail and by reference characters to the drawings which illustrate preferred embodiments of the present invention, A designates a game apparatus which includes a peripherally extending frame 10 having opposed end rails 12 and longitudinally extending goal rails 14. Each of the longitudinally extending rails 14 merge into diagonally located, outwardly struck arms 16, which, in turn, are connected by longitudinally extending legs or side rails 18, to thereby provide a pair of opposed transversely outset areas 20 within the frame 10. Each of the interior surfaces of the rails 12 and 14 and the arms 16 and legs 18 serve as rebound surfaces. Moreover, bumper pads 22 are located in the area of each of the diagonally located outwardly struck arms 16, and these rebound pads 22 extend into the interior of the frame 10 and provide rebound surfaces 24 generally facing toward one player end and the rebound surfaces 26 generally facing toward one player end and the rebound surfaces 26 generally facing toward the other player end.

A playing board 28 extends between each of opposed player ends designated by reference numerals 30 and 32. The playing board 28 has a generally solid upper playing surface 34 defined by a transversely extending, centrally located high point or ridge 36, the playing surface 34 extending generally downwardly toward each of the player ends 30 and 32. The playing board 28 is generally carried between each of the player ends such that the surface is defined by a generally continuous arc.

FIG. 3 illustrates a modified form of game playing board which may also be used in the present invention and which is designated by reference numeral 28'. In this case, the game playing board 28' is comprised of a pair of relatively flat inclined planar board sections 38 and 39 connected by an arcuate section 40. The game board 28' has a generally solid upper playing surface 34' defined by a transversely extending, centrally located high point or ridge 36' located at the apex of the arcuate section 40. In this case, it can be observed that the playing board 28' is essentially similar in operation to the playing board 28. However, it should be understood that the angle defined by the inclined board sections 38 and 39 should be sufficiently large so that the playing piece does not lift off of the game board at the high point due to the change of angle of the playing surface. The arcuate section 40 also serves to alleviate this condition.

In each of these embodiments the playing piece, in the form of a ball, designated by reference numeral P, will always roll downwardly toward one player end 30 or the other player end 32, depending upon its location relative to the high point 36.

In each of the aforementioned embodiments of the game apparatus, it is not necessary to employ the bumper pads 24. However, these bumper pads do serve to increase the number of possible rebound trajectories of the playing piece and therefore increase the player participation and the required skill of the players. Moreover, it is not necessary to employ the offset areas 20, such that the game board could be of generally rectangular shape. However, it has been found that the use of a rectangularly shaped game board without the employment of the offset areas 20 tends to increase the speed of operation of the game significantly and materially increase the difficulty of playing the game.

Each of the player ends 30 and 32 are provided with transversely extending goal areas 42 located adjacent to each of the player ends 30 and 32. A pair of transversely extending rectangularly shaped recesses 44 are formed in the game board 28 and are located slightly inwardly of the respective goal areas 44 and which extend between the two longitudinal walls 14 for reasons which will presently more fully appear. In this case, each of the transversely extending recesses 44 are connected to the associated goal areas 42 through a horizontal shoulder surface 50 where the transverse ends of the playing board 28 merge into the recesses 44. However, each of the shoulder surfaces 50 are located in a plane somewhat below the upper surface of the playing surface. Moreover, each of the goal areas 42 are provided with goal pockets, or so-called "goal recesses," 52, which are defined by a transversely extending, vertically disposed goal wall 54 connected to the shoulder surface 50 and merging into a bottom wall 56. The functions of each of the goal pockets 52 and their positional relationship are defined in more detail hereinafter.

Located within each of the recesses 44 are transversely shiftable player arms or support means 58, in the manner as illustrated in FIGS. 2 and 3. The player arms 58, which are also referred to as an "actuating arm" or "support member" extend transversely through apertures formed within the vertical walls 14, in the manner as illustrated in FIGS. 1 and 6 of the drawings. In this case, it can be observed that an individual player arm 58 is located at each player end 30 and 32.

The player arms 58 have upper surfaces 60 which are substantially contiguous with the playing surface 34 of the game board 28 and above the shoulder surfaces 50. In this way, when the playing piece P is rolled across the game board 28, it will move across the upper surface 60 of each of the player arms 58 and across the relatively short shoulder surfaces 50 in the same manner as though the upper surfaces 60 constituted part of the playing surface 34. Moreover, each of the upper surfaces 60 on the player arms 58 connects to the shoulder surfaces 50 which terminate toward a player end at each of the goal pockets 52, such that the playing piece P which moves over the playing surface 34 and the upper surface 60 of the player arm 58 may be deposited in any one of the goal pockets 52 at either of the player ends.

While the upper surfaces 60 and shoulder surfaces 50 are relatively flat, they are relatively thin in the transverse dimension so that they do not impair the movement of a playing piece P into the goal cups 52. However, it should be recognized that the upper surfaces 60 could be arcuately shaped with a radius conforming to the player surface 34 so as to be arcuately contiguous therewith. In addition, the recesses 44 could actually form part of the goal areas if desired, thereby eliminating the shoulder surfaces 50. In this case, a playing piece passing over the upper surfaces 60 of the arms 58 would be introduced directly into one of the goal cups 52.

Each of the actuating arms 58 carry a pair of movable striker elements in the form of rotatable flippers 62 and 64 which are rotatably movable from a rearward, or unactuated, position, as illustrated by the phantom lines in FIG. 6, to a forward, or actuated, position, illustrated by the solid lines in FIG. 6. The exact angle of movement from the rearward to the forward position of each of the flippers 62 and 64 is dependent upon their overall length and the overall length of the player arms 58. However, typically, the flippers 62 and 64 will flip through about a 60° to about a 90° arc.

Each of the flippers 62 and 64 may be actuated by manually operable push-button actuators 66 and 68, respectively, on each of the transverse ends of the player arms or support members 58. Thus, when the push-button actuator 66 or the actuator 68 is pushed inwardly with respect to the support rod 58, the associated flipper 62 or 64 will shift from the unactuated to the actuated position by means of an actuating mechanism hereinafter described in more detail. In accordance with the present construction, each of the flippers 62 and 64 are independently operable, although they could be constructed to be operable simultaneously, if desired, by pushing one of the push-button actuators 66 or 68.

In accordance with the rules of play of the game apparatus, when the playing piece P is projected toward one player end, the player will shift the player rod 58 from side to side and will also actuate the push-button actuators 66 or 68 associated therewith. When pushing the push-button actuator 66, the flipper 62 will be propelled forwardly and when actuating the push-button actuator 68, the flipper 64 will be pushed forwardly to the actuated position. The player will attempt to align the particular flipper with respect to the playing piece P in order to propel this playing piece toward the opponent player's goal area.

FIG. 4 illustrates one form of playing piece P in the form of a round ball which may be either a hollow ball or a solid ball, or any form of spherical object. In this respect, it should be observed that the particular playing piece could adopt the form associated with a particular playing sport. However, a round ball is preferred on a relatively solid playing surface due to the lower frictional effects and due to the fact that a round ball can roll across the playing surface as opposed to sliding across the playing surface.

The actuating mechanism which permits actuation of the flippers 62 and 64 is more fully illustrated in FIG. 5 of the drawings. Only one such actuating mechanism is illustrated in connection with the flipper 62, although each of the other such actuating mechanism operate in like manner. The flipper 62 is located on the upper surface 60 of the support member 58, and is pivotally retained thereon by means of a pivot pin 70. The support member 58 is hollow providing a central interior chamber 72 and located within the chamber 72 is a link 74 which is also mounted on the pivot pin 70 and pivotal with the flipper 62. The link 74 is connected through a relatively rigid rod or guy wire 76 to a connecting rod 78 which is attached to the push-button actuator 66. In this case, it can be observed that the rod 78 extends into the central chamber 72 of the arm 58 and is biased outwardly by means of a compression spring 80 which bears against the inner surface of a limit plate 81 on the actuator 66 and also against a retaining plate 82 extending across the chamber 72 of the arm 58.

It can be observed that when the push-button actuator 66 is in its outermost position, or unactuated position, the flipper 62 will assume its unactuated position, as illustrated in the dotted lines of FIG. 7 and the solid lines of FIG. 6. However, when the push-button actuator 66 is urged inwardly, the link 74 will shift in a clockwise direction and urge the pivot pin 70, and the flipper 62 carried therewith, to the actuated position as illustrated in the solid lines of FIG. 6 and the dotted lines of FIG. 7. In addition, it can also be observed that when manual pressure on the push-button actuator 66 is released, the compression spring 80 which has now been compressed will bias the pushbutton actuator 66 outwardly and will also return the link 74 to its position as illustrated in the solid lines of FIG. 5, and will also return the flipper 66 to its unactuated position, as also illustrated in the solid lines of FIG. 7.

Referring now to FIGS. 6–8, it can be understood how the arm 58 and the flippers thereon are shiftable in relationship to the playing board 34. By further reference to FIG. 6, it can be observed that when the arm 58 is in its normal position, that is the position when each of the outwardly extending ends are approximately the same distance from the longitudinal walls 14, that a first playing piece passageway $S_1$ is created between each of the two flippers 62 and 64 on the arm 58. Moreover, it can be observed that the rebound pads 22 extend inwardly sufficiently to create a second playing piece passageway $S_2$ between the flipper 62 and the pad 22. Finally, a third playing piece passageway $S_3$ is created between the opposed flipper 64 and the upper pad 22. In this case, it can be observed that when the flipper arms are flipped from the unactuated position to the actuated position, or otherwise remain in the unactuated position, the passageway $S_1$ is sufficient to permit the playing piece P to pass therethrough into any one of the goal cups 52. In addition, the playing piece P can also pass through the passageways $S_2$ or $S_3$.

In order to more the support arms 58, the players will grasp or engage the two transverse outer ends of the arms, one end with each hand, and in this way the shiftable arms 58 are moved generally with both hands of the players. The transverse movement will normally occur in an attempt to align one of the flippers with the trajectory of an approaching playing piece. Each player will also generally contemporaneously actuate the actuator button 16 on one or both of the outer transverse ends of his support arm 58 to actuate the associated flipper.

Referring to FIG. 7, it can be observed that when the arm 58 is shifted toward one position where the flippers 62 are located nearest one of the end walls 14, the passageway $S_2$ has been eliminated for passage of the playing piece P. However, the passageway $S_3$ is substantially wider and, in addition, the passage $S_1$ still exists. By examining FIG. 7, it can be observed that when the arm 58 is shifted in the opposite direction so that the flipper 64 is located nearest one of the longitudinal walls 14, the passage $S_3$ is eliminated. However, the passageway $S_2$ is substantially wide and, here again, the passageway $S_1$ exists.

In order to play the game of the present invention, the playing piece is first deposited on the playing surface 34. One of the players at one of the playing ends 30 or 32 will attempt to shift the arm 58 in order to locate a flipper 62 or 64 in alignment with the playing piece P. When so aligned, the player will actuate the push-button actuator 66 or 68 in order to propel the playing piece P to the opposite player end. The player at the opposite player end will thereupon shift the arm 58 to the proper position so that one of the flippers 62 or 64 is located in alignment with the trajectory of the playing piece P. This latter player will also actuate one of the push-button actuators 66 or 68 in order to operate the associated flipper 62 or 64, and thereby propel the playing piece back to the first player's goal area.

In accordance with the present invention, it can be observed that due to the inclined nature of the playing surface 34 toward each of the goal areas, that the playing piece will always move toward one or the other of the goal areas. Consequently, it is encumbent upon the player to shift the arm 58 and actuate the flipper 62 or 64 in order to repel the playing piece P, or otherwise the playing piece P would likely fall within one of the goal cups 52. It can be observed, in this respect, that the game of the present invention can be operated in a relatively quick manner and not only requires skill, but requires quick and keen action on the part of each of the players. Moreover, the players must carefully locate the particular arm 58 and properly actuate the flippers 62 or 64 in a time-related manner to the movement of the playing piece P in order to repel this playing piece so that it is moved in through one of the passageways $S_1$ or $S_2$ or $S_3$ into the goal cups 52.

If one of the players propels the playing piece P in a trajectory which does not align with the opposing game area, it may carrom, i.e. abut against the opposite rebound surface 24 and be propelled back into the player's own goal area. Consequently, each player must operate the player arm 58 and the flippers 62 and 64 in such manner so that the playing piece P does not engage the bumper pads 22 for rebound toward its own goal area.

In order to control the transverse shiftable movement of the player arms 58, enlarged abutment flanges 84 are located on the arms 58 outwardly of each of the longitudinal walls. If desired, these abutment flanges 84, which serve as stops shiftable on the arm 58 to serve as an adjustable control. In addition, it should be understood that the flippers 62 and 64 could be located with their pivot points close to the bumper pads 22 so as to eliminate a passageway therebetween. In this latter construction, the flipper arms 58 would probably have a longer length. Moreover, it should also be observed that the flippers 62 and 64 could be substituted by other forms of striker elements, as for example, longitudinally movable paddles or the like, and which striker elements would also be actuated by the actuators 66 or 68.

In the case of the present invention, each of the goal cups 52 may be assigned a particular value, depending upon the degree of skill required to deposit the playing piece P into that particular goal cup. In the particular embodiment, as illustrated, the opposite end goal cups achieve the highest number of scored points when the playing piece is deposited in such goal cups. The next two outermost goal cups receive the next highest number of paints, and the center goal receives the lowest number of points. It can be observed that greater skill, and hence greater difficulty, is inherent in achieving a goal in the outermost goal cups, and the easiest score is obtained in shifting the playing piece into the center goal cup. Nevertheless, it should be understood that the game could be designed with respect to the relationship of the flippers on the support arms so that the goal cups could be assigned different score values.

Thus, there has been illustrated and described a unique and novel playing game which fulfills all of the objects and advantages sought therefor. It should be understood that many changes and modifications and other uses and applications will become apparent to those skilled in the art after considering this specification and the accompanying drawings. Therefore, any and all such changes, modifications and other uses and applications which do not depart from the spirit and scope of the invention are deemed to be covered by the invention which is limited only by the following claims.

Having thus described our invention, what we desire to claim and secure by letters patent is:

1. A game apparatus where a pair of opposed players attempt to propel a spherical playing piece toward and into a goal area at the opposite end of a playing surface, said apparatus comprising:

a. a game board defining a substantially solid playing surface having a goal area at each of a pair of opposed ends thereof, b. said playing surface having a high section intermediate each of said goal areas and inclining downwardly from said high section toward each of said goal areas so that the spherical playing piece will always roll down one of said inclines toward one or the other of said goal areas, c. rebound means surrounding said playing surface except at said goal areas to retain and repel a playing piece used on said playing surface, d. a pair of support means disposed on said playing surface, each support means being located in relation to one of said goal areas being manually transversely shiftable in a direction generally normal to a line extending from one of said goal areas to the other of said goal areas, e. at least one actuable striker means movable with each of said support means and being movable relative to said support means to engage the playing piece when actuated, and f. means operatively associated with each support means and manually operable to actuate the striker element associated therewith, said support means being provided with portions which extend outwardly of said rebound means, said means to actuate the striker means being located at opposite ends of said support means, said striker actuating means comprising a pair of movable actuator members which each extend outwardly of one of the extended portions of the support means and are movable inwardly to actuate the striker means so that the user can grasp said extended portions with his hands and effect transverse movement of the support means while concurrently using the fingers of his hands to move the actuator members inwardly so as to actuate the striker means.

2. The game apparatus of claim 1 further characterized in that the striker means on each of said support means comprises a pair of manually actuable flipper elements which are spaced apart from each other.

3. The game apparatus of claim 2 further characterized in that bumper pads are operatively located on said game board in regions where said flipper elements can be located in close proximity to said bumper pads.

4. The game apparatus of claim 2 further characterized in that said flipper elements define a first passageway therebetween, and a second passageway between one of said flipper elements and said rebound means when said support means is shifted in a first direction and a third passageway between the other of the flipper elements and the rebound means when said support means is shifted in a second direction, and where each of said passageways are sized to permit passage through said passageways and into the goal areas associated therewith.

5. The game apparatus of claim 2 further characterized in that each of flipper elements can be shifted from an unactuated position to an actuated position where they are projected toward the opposed player ends in the actuated position.

6. The game apparatus of claim 1 further characterized in that said playing surface is substantially arcuate over its entire length from one player end to the other end and that the high section is substantially equidistant the ends thereof.

7. The game apparatus of claim 1 further characterized in that said playing surface comprises a pair of flat sections connected by an arcuate section and each of which flat sections extend upwardly from said goal areas to a high point on said arcuate section substantially equidistant the ends thereof.

8. The game apparatus of claim 1 further including a playing piece in the form of a round ball.

9. A method of playing a game where a playing piece can be moved across a substantially solid game board toward one or another of a pair of opposed goal areas by players actuating striker members, the game board being raised intermediate the goal areas and inclining downwardly toward said goal areas, said method comprising:

a. introducing a playing piece on said game board and causing said playing piece to move down an incline of the game board toward one or another of the goal areas, b. attempting to engage and propel the playing piece approaching a goal area of a player by:

1. holding at least one outer end of a transversely movable support member associated with a goal area, and with said outer end being held with one of the individual hands of that player,
2. transversely shifting said support member associated with one of each of said goal areas in a direction generally transverse to a line extending between said goal areas by movement with said one hand of the player, and
3. generally contemporaneously with the transverse shifting movement of the support member actuating a striker element on the support member by manually actuating with said same one hand a striker actuator on the end of the support member in generally inward transverse movement from said end of said support member.

10. A method of playing a game where a playing piece can be moved across a substantially solid game board toward one or another of a pair of opposed goal areas by players actuating striker members, the game board being raised intermediate the goal areas and inclining downwardly toward said goal areas, said method comprising:

a. introducing a playing piece on said game board and causing said playing piece to move down an incline of the game board toward one or another of the goal areas, b. attempting to engage and propel the playing piece approaching a goal area of a player by:

1. holding both outer ends of a transversely movable support member associated with a goal area, and with each of said outer ends being held with one of the individual hands of that player,
2. transversely shifting said support member associated with one of each of said goal areas in a direction generally transverse to a line extending between said goal areas by movement with said hands of the player, and
3. generally contemporaneously with the transverse shifting movement of the support member with both the player's hands also actuating a striker element on the support member by manually actuating with at least one of the player's hands a striker actuator element on the end of the support member in generally transverse movement.

11. A game apparatus where a pair of players positioned at opposite ends of a playing surface each attempt to propel a playing piece toward a goal area at the opposite end of the surface, said apparatus comprising:

a. a game board defining a substantially solid, uninterrupted playing surface, said playing surface having a goal area at each of a pair of opposed ends thereof, b. said playing surface having a high section intermediate said goal areas and inclining downwardly from said high section toward each of said goal areas, c. means forming at least one recess at each of said goal areas, d. an elongated support member having opposed ends and located in each said recess and being shiftable generally transverse to a line extending between said goal areas, said support members each having an upper surface which is substantially contiguous with and forms a continuation with said playing surface, and e. actuable striker means movable with each of said support members and being actuable by generally inward movement from an end of said support member to move relative to its support member to engage said playing piece and repel same toward the other goal area.

12. The game apparatus of claim 11 further characterized in that each of said striker means comprise at least one flipper element rotatably mounted on said respective support members, and manually actuable means is operatively associated with each said striker means to actuate same.

13. The game apparatus of claim 11 further characterized in that each of said support members carries a pair of manually actuable flipper elements thereon which are spaced apart from each other.

14. The game apparatus of claim 13 further characterized in that said flipper elements define a first passageway therebetween, and a second passageway between one of said flipper elements and said rebound means when said support member is shifted in a first direction and a third passageway between the other of the flipper elements and the rebound means when said support member is shifted in a second direction, and where each of said passageways are sized to permit passage through said passageways and into the goal areas associated therewith.

15. The game apparatus of claim 11 further characterized in that rebound means surrounds said playing surface except at the goal areas to retain and repel the playing piece used on said surface.

16. A game apparatus where a pair of opposed players each attempt to propel a playing piece toward a goal area at the opposite end of a playing surface, said apparatus comprising:

a. a game board defining a playing surface having a pair of goal areas, one at each of a pair of opposed ends thereof, b. said playing surface having a high section intermediate said goal areas and inclining downwardly from said high section toward each of said goal areas, c. peripheral rebound means extending upwardly from said playing surface to retain a playing piece on said game board, d. a pair of support members, each located in relation to one of said goal areas and being transversely shiftable, said support members each having at least one end portion extending outwardly and beyond said game board and rebound means, e. at least one manually actuable striker element movable with each support member and being movable relative thereto to engage a playing piece when actuated, f. and actuable means located at said end portion of each support member and movable generally inwardly to actuate the striker element associated therewith.

17. The game apparatus of claim 16 further characterized in that each support member has an opposed pair of said end portions, a pair of spaced apart striker elements are located on each support member, and an individual actuable means is located at each end portion of each support member to actuate one of the striker elements associated with said actuable means.

* * * * *

UNITED STATES PATENT OFFICE

CERTIFICATE OF CORRECTION

PATENT NO. : 4,046,380

DATED : September 6, 1977

INVENTOR(S) : Adolph E. Goldfarb, et al

It is certified that error appears in the above-identified patent and that said Letters Patent are hereby corrected as shown below:

In Claim I, Column 8, line 55, after "areas" insert -- and --

Signed and Sealed this

*Twenty-seventh* Day of *December 197*

[SEAL]

*Attest:*

RUTH C. MASON
*Attesting Officer*

LUTRELLE F. PARKER
*Acting Commissioner of Patents and Trademark*